US009347412B2

(12) United States Patent
Fath et al.

(10) Patent No.: US 9,347,412 B2
(45) Date of Patent: May 24, 2016

(54) DAMPING ELEMENT FOR AN ARRANGEMENT OF A CYLINDER HEAD OF AN INTERNAL COMBUSTION ENGINE AND AN INJECTION VALVE

(75) Inventors: Jens Fath, Regensburg (DE); Joachim Wagner, Dietfurt a. d. Altmühl (DE); Rainer Weber, Regensburg (DE); Marco Haller, Regensburg (DE); Robert Kuchler, Regen (DE)

(73) Assignee: CONTINENTAL AUTOMOTIVE GMBH, Hannover (DE)

( * ) Notice: Subject to any disclaimer, the term of this patent is extended or adjusted under 35 U.S.C. 154(b) by 586 days.

(21) Appl. No.: 13/704,673

(22) PCT Filed: Jun. 9, 2011

(86) PCT No.: PCT/EP2011/059574

§ 371 (c)(1),
(2), (4) Date: Feb. 13, 2013

(87) PCT Pub. No.: WO2011/157619

PCT Pub. Date: Dec. 22, 2011

(65) Prior Publication Data

US 2013/0146026 A1 Jun. 13, 2013

(30) Foreign Application Priority Data

Jun. 17, 2010 (DE) ..... 10 2010 024 140

(51) Int. Cl.
*F02M 61/14* (2006.01)
*F02M 61/16* (2006.01)

(52) U.S. Cl.
CPC ..... *F02M 61/16* (2013.01); *F02M 61/14* (2013.01); *F02M 2200/09* (2013.01); *F02M 2200/858* (2013.01)

(58) Field of Classification Search
CPC . F02M 61/14; F02M 61/16; F02M 2200/858; F02M 2200/09
USPC ..... 123/470; 277/549, 591
See application file for complete search history.

(56) References Cited

U.S. PATENT DOCUMENTS 5,706,787 A * 1/1998 Fujikawa ..... 123/470
6,745,956 B1 6/2004 Bantle et al. ..... 239/533.3

(Continued)

FOREIGN PATENT DOCUMENTS

CN 2835609 Y 11/2006 ..... F02B 23/06
DE 19941930 A1 3/2001 ..... F02M 61/14

(Continued)

OTHER PUBLICATIONS

Chinese Office Action, Application No. 201180029849.6, 12 pages.

(Continued)

*Primary Examiner* — Hai Huynh
(74) *Attorney, Agent, or Firm* — Slayden Grubert Beard PLLC

(57) ABSTRACT

A damping element implemented for damping a vibration transmitted between an injection valve and a cylinder head of an internal combustion engine may include a base body substantially shaped as a ring washer and at least one first contact segment fixedly coupled to the base body and protruding past the base body in a first axial direction and a second contact segment fixedly coupled to the base body and protruding past the base body in a second axial direction opposite the first axial direction. The first at least one contact segment has a radial offset from the longitudinal axis that is unequal to a radial offset of the second contact segment from the longitudinal axis.

9 Claims, 4 Drawing Sheets

(56) References Cited

U.S. PATENT DOCUMENTS

| | | | | |
|---|---|---|---|---|
| 7,373,925 | B2 * | 5/2008 | Reiter et al. | 123/470 |
| 7,823,565 | B2 * | 11/2010 | Chern | F02M 55/004 123/192.1 |
| 7,832,376 | B2 * | 11/2010 | Mueller et al. | 123/470 |
| 8,069,842 | B2 * | 12/2011 | Kannan | 123/470 |
| 8,100,408 | B2 | 1/2012 | Kurth | 277/572 |
| 8,469,004 | B2 * | 6/2013 | Solferino et al. | 123/470 |
| 8,714,139 | B2 * | 5/2014 | Holt et al. | 123/470 |
| 8,875,683 | B2 * | 11/2014 | Holt et al. | 123/470 |
| 2015/0013644 | A1 * | 1/2015 | Friedrich | F02M 55/004 123/470 |

FOREIGN PATENT DOCUMENTS

| | | | | |
|---|---|---|---|---|
| EP | 0825342 | A1 | 2/1998 | F02F 1/24 |
| EP | 1983187 | A1 | 10/2008 | F02M 61/14 |
| FR | 2862717 | A1 | 5/2005 | F02M 61/14 |
| JP | 9242647 | A | 9/1997 | F02M 61/14 |
| WO | 2011/157619 | A1 | 12/2011 | F02M 61/14 |

OTHER PUBLICATIONS

International Search Report and Written Opinion, Application No. PCT/EP2011/059574, 15 pages.

* cited by examiner

DAMPING ELEMENT FOR AN ARRANGEMENT OF A CYLINDER HEAD OF AN INTERNAL COMBUSTION ENGINE AND AN INJECTION VALVE

CROSS-REFERENCE TO RELATED APPLICATIONS

This application is a U.S. National Stage application of International Application No. PCT/EP2011/059574 filed Jun. 9, 2011, which designates the United States of America, and claims priority to DE Application No. 10 2010 024 140.7 filed Jun. 17, 2010, the contents of which are hereby incorporated by reference in their entirety.

TECHNICAL FIELD

The disclosure relates to a damping element and an arrangement composed of a cylinder head of an internal combustion engine and an injection valve having a damping element.

BACKGROUND

Injection valves are used to inject fuel into combustion chambers of an internal combustion engine. In the case of a fuel internal combustion engine, the fuel is injected at a pressure of up to 200 bar, and in the case of a diesel internal combustion engine the fuel is injected into the combustion chambers at a very high pressure of up to 2000 bar. The injection valves which are used for internal combustion engines in this case make stringent requirements of the accuracy of the parameters which determine the injection of the fuel into the combustion chambers of the internal combustion engine. This is particularly important since ever stricter legal prescriptions are issued for the permissible emission of pollutants by internal combustion engines which are arranged in motor vehicles. These requirements make it necessary to perform various measures which reduce the emissions of pollutants.

During the operation of the internal combustion engine, the injection valves are subjected to high mechanical loading. It is therefore possible, in particular, for shocks to occur to the injection valves in the cylinder heads of the internal combustion engine.

SUMMARY

In one embodiment, a damping element is designed to damp a vibration transmitted between an injection valve with a central longitudinal axis and a cylinder head of an internal combustion engine, wherein the damping element includes a ring-washer-shaped base body, and at least one first contact section which is fixedly coupled to the base body and protrudes beyond the base body in a first axial direction, and a second contact section which is fixedly coupled to the base body and protrudes beyond the base body in a second axial direction opposed to the first axial direction, wherein the at least one first contact section has a radial distance from the longitudinal axis which is unequal to a radial distance of the second contact section from the longitudinal axis.

In a further embodiment, the damping element comprises two first contact sections which are fixedly coupled to the base body and protrude beyond the base body in the first axial direction, wherein the radial distance of the second contact section from the longitudinal axis has a value which is between the values of the radial distances of the first contact sections from the longitudinal axis.

In a further embodiment, at least one of the contact sections is embodied at least partially in a ring shape around the central longitudinal axis.

In a further embodiment, the damping element is embodied as a disk spring.

In another embodiment, an arrangement includes a cylinder head of an internal combustion engine, which cylinder head has a recess and a step which is formed in the recess, an injection valve which has a central longitudinal axis and is at least partially arranged in the recess, and a damping element as disclosed above, which is arranged axially in the recess between the injection valve and the step.

In a further embodiment, the injection valve has a clamping element for clamping the injection valve into the recess, and the damping element is coupled in one piece to the clamping element.

BRIEF DESCRIPTION OF THE DRAWINGS

Exemplary embodiments are explained in more detail below with reference to schematic drawings, in which.

DETAILED DESCRIPTION

Figure 1:
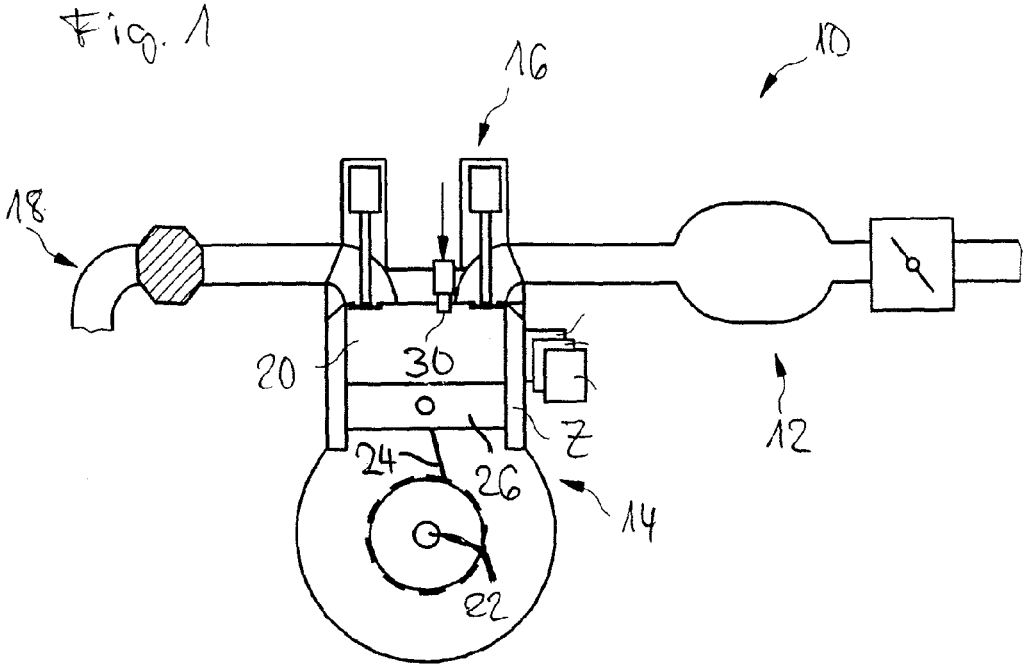
FIG. 1 shows a schematic view of an internal combustion engine.

Embodiments of the present disclosure provide an arrangement composed of a cylinder head of an internal combustion engine and an injection valve which permit the internal combustion engine to operate with low emissions of pollutants and allow a simple design of the arrangement composed of the cylinder head of an internal combustion engine and the injection valve.

Some embodiments provide a damping element which is designed to damp a vibration transmitted between an injection valve with a central longitudinal axis and a cylinder head of an internal combustion engine. The damping element has a ring-washer-shaped base body. The damping element has at least one first contact section which is fixedly coupled to the base body and protrudes beyond the base body in a first axial direction, and a second contact section which is fixedly coupled to the base body and protrudes beyond the base body in a second axial direction opposed to the first axial direction. The at least one first contact section has a radial distance from the longitudinal axis which is unequal to a radial distance of the second contact section from the longitudinal axis. The terms "axial direction" and "longitudinal axis" preferably relate here to the central longitudinal axis of the injection valve.

The damping element (44) may be used in an arrangement having a cylinder head of an internal combustion engine, which cylinder head has a recess and a step which is formed in the recess, an injection valve which has a central longitudinal axis and is at least partially arranged in the recess, and the damping element. The damping element may be arranged axially in the recess between the injection valve and the step here.

The damping element may be designed, for example, to damp a vibration transmitted between the injection valve and the cylinder head in the direction of the longitudinal axis.

Such damping elements may have the advantage that an axial movement of the injection valve can be transformed into an internal movement of the damping element, which internal movement is transmitted to the cylinder head only to a small extent or not at all. As a result of its design, the damping element can therefore bring about a deflection of the force of flux, which may ensure low generation of noise by the internal combustion engine. A further effect of the damping element is changing of the vibration system which is composed, inter alia, of the cylinder head and the injection valve. A frequency shift into a frequency range which is tolerable for people is thus possible. Furthermore, noise generated by the combustion and the assemblies can be superimposed on the shocks generated in this frequency region by the injection valve. Furthermore, either an increase in the pressure per unit of surface area or a reduction in the prestressing force of the injection valve can be achieved. Correspondingly configuring the damping element additionally makes it possible to compensate the different expansion coefficients of the cylinder head and of the injection valve. This can lead to a prestressing force which is constant over the entire temperature range.

In one embodiment, the damping element has two first contact sections which are fixedly coupled to the base body and protrude beyond the base body in the first axial direction. The radial distance of the second contact section from the longitudinal axis has a value which is between the values of the radial distances of the first contact sections from the longitudinal axis. Thus, in addition to the damping behavior a very good sealing behavior of the damping element can also be achieved.

In a further embodiment, at least one of the contact sections is embodied at least partially in a ring shape around the central longitudinal axis. Thus, good damping of the vibrations can be achieved over the entire circumference of the damping element, together with a good sealing behavior of the damping element.

In a further embodiment, the damping element is embodied as a disk spring. Thus, the damping element may have a simple design with two contact sections with different radial distances from the longitudinal axis as well as a small contact surface between the damping element, on the one hand, and the injection valve and the step formed in the recess, on the other, as a result of which the vibrations of the injection valve can be transmitted in a well damped fashion to the cylinder head.

In a further embodiment, the injection valve has a clamping element for clamping the injection valve into the recess. The damping element is coupled in one piece to the clamping element. As a result, good damping of the vibrations as well as a particularly good sealing behavior of the damping element can be achieved.

FIG. 1 shows a schematic view of an internal combustion engine 10, having an intake section 12, an engine block 14, a cylinder head 16 and an exhaust section 18. The intake section 12 leads towards a cylinder Z via an intake duct and into a combustion chamber 20 of the engine block 14. The engine block 14 also has a crank shaft 22 which is coupled to a piston 26 of the cylinder Z via a connecting rod 24. In addition to the cylinder Z, further cylinders may also be provided.

Figure 2:
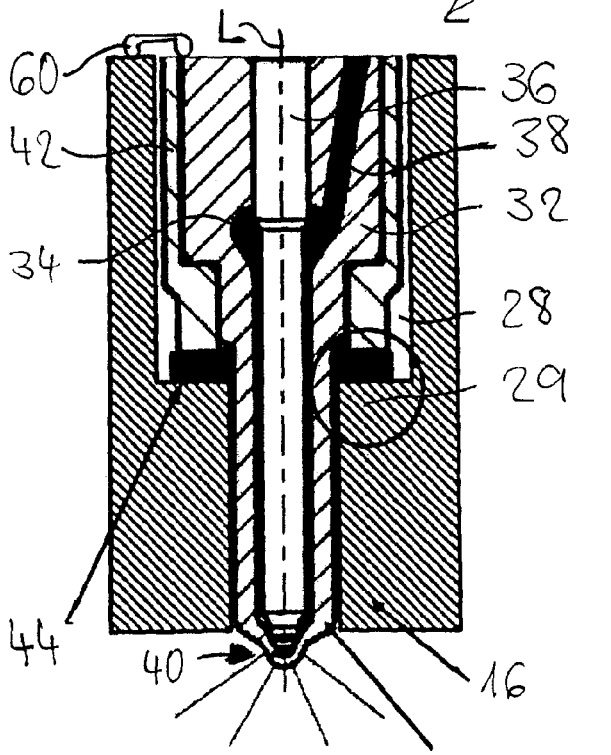
FIG. 2 shows part of an injection valve and of a cylinder head of the internal combustion engine.

FIG. 2 shows an arrangement composed of the cylinder head 16 and an injection valve 30. The cylinder head 16 has a recess 28. A step 29 of the cylinder head 16 is formed in the recess 28. A section of the injection valve 30 is arranged in the recess 28. The injection valve 30 has an injector body 32. The injector body 32 is embodied in a plurality of pieces in the embodiment shown here. The injector body 32 can also be embodied in one piece. The injector body 32 has a central longitudinal axis L and a recess 34. A nozzle needle 36 is arranged in the recess 34 in the injector body 32, which nozzle needle 36 can be embodied as a single part or as multiple parts. The injector body 32 comprises a high-pressure line 38 via which the injection valve 30 is connected to a high-pressure circuit (not illustrated) of a fluid. One or more injection openings 40 are arranged at an axial end in the injector body 32. In a closing position of the nozzle needle 36 a flow of fluid through the at least one injection opening 40 is prevented and otherwise a flow of fluid through the at least one injection opening 40 is enabled.

The injection valve 30 has a clamping element 42 which is arranged in the recess 28 in the cylinder head 16. The clamping element 42 may be embodied as a nozzle clamping nut and serves to secure the injection valve 30 with respect to the cylinder head 16.

A damping element 44 is arranged in the recess 28 in the cylinder head 16. The damping element 44 is arranged axially between the injection valve 30 and the step 29 formed in the recess 28 in the cylinder head 16. The damping element 44 may be arranged axially between the injector body 32 and the step in the cylinder head 16. Vibrations, such as can occur during the operation of the internal combustion engine owing to the shocks which occur and which are transmitted between the injection valve 30 and the cylinder head 16, can be damped by means of the damping element 44. In particular, a vibration transmitted between the injection valve 30 and the cylinder head 16 in the direction of the longitudinal axis L of the injection valve 30 can be damped. The damping element 44 can bring about a change in the vibration system which is composed of the cylinder head 16, the injection valve 30 and attachment elements 60, to form a frequency shift into a frequency range which is easily tolerated by people. Furthermore, either an increase in the pressure per unit of surface area or a reduction in the prestressing force of the injection valve 30 can be brought about. In addition, compensation of the different expansion coefficients of the cylinder head 16 having the attachment elements 60 and the injection valve 30 can be achieved by correspondingly configuring the damping element 44. This can lead to a prestressing force which is constant over the entire temperature range. The damping element 44 is embodied, in particular, as a single-piece ring.

The damping element may be composed at least partially of a material having a high vibration damping capacity (intrinsic damping) in the desired frequency range and temperature range. In particular, a high level of axial rigidity and positioning of the nozzle tip are achieved in a temperature range from over −40° C. and from below 250° C. up to a pressure of up to 250 bar. Furthermore, the material used may be resistant to fuels and the combustion products thereof.

The damping element 44 is composed, in particular, entirely or partially of a metal alloy with which a good level of durability of the damping element 44 can be achieved even at temperatures of up to 250° C. and pressures of up to 250 bar. Furthermore, such alloys can be particularly resistant to fuels and their combustion products.

Figure 3A:
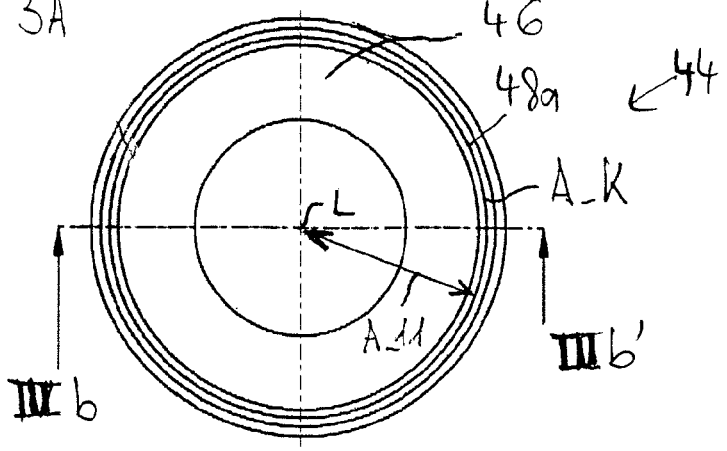
FIGS. 3A and 3B show a damping element in a plan view and in a longitudinal section.
Figure 3B:
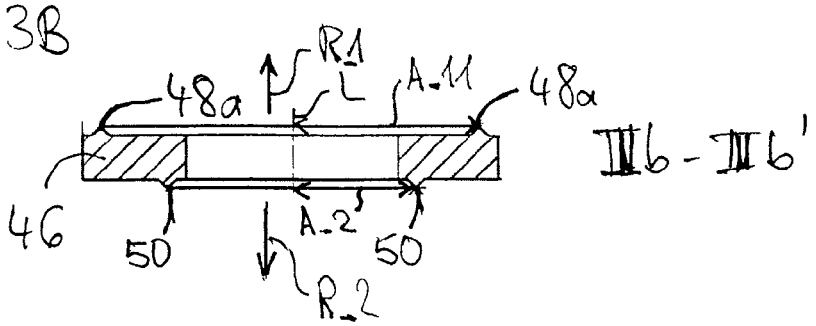

The damping element 44 has a base body 46. The base body 46 is embodied as a ring washer. The damping element 44 has a first contact section 48*a* which is fixedly coupled to the base body and extends, in a first axial direction R_1, beyond the base body 46 to the injection valve 30. The first contact section 48*a* is at a radial distance A_11 from the longitudinal axis L. The damping element 44 has a second contact section 50 which is fixedly coupled to the base body 46 and extends to the step 29 beyond the base body 46 in a second axial direction R_2. The second contact section 50 is at a radial distance A_2 from the longitudinal axis L. The radial distance A_11 of the first contact section 48*a* is unequal to the radial distance A_2 of the second contact section 50 (FIGS. 3A and 3B). By means of the different radial distances A_11, A_2 between the contact sections 48*a*, 50 it is possible to convert an axial movement of the injection valve 30 into a vibrational movement of the damping element 44, and therefore for dissipation of energy in the damping element 44 to take place with the result that kinetic energy is transmitted to the cylinder head only to a small degree or not at all, to which, in particular, the small contact area between the damping element 44 and the step 29 can contribute. As a result, good vibration damping is achieved by the damping element 44.

Figure 4A:
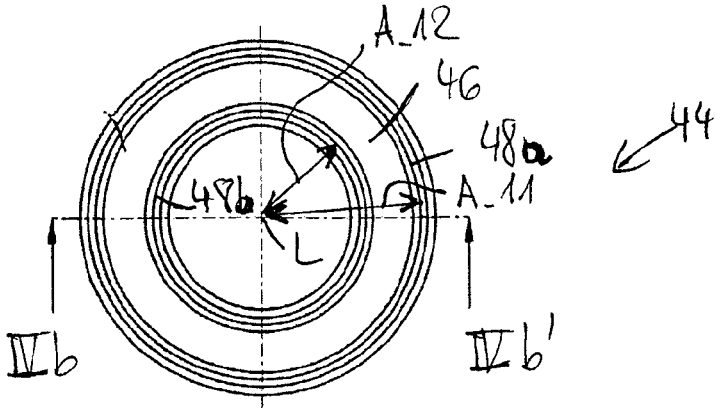
FIGS. 4A and 4B show a damping element in a plan view and in a longitudinal section.
Figure 4B:
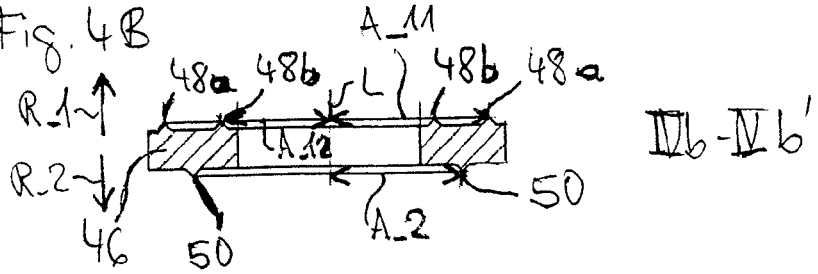

In the embodiment in FIGS. 4A and 4B, the damping element 44 has a further first contact section 48*b* which is fixedly coupled to the base body 46 and extends beyond the base body 46 to the injection valve 30 in the first axial direction R_1, and is at a radial distance A_12 from the longitudinal axis L. The radial distance A_2 of the second contact section 50 is shorter than the radial distance A_11 of the first contact section 48*a* and longer than the radial distance A_12 of the further first contact section 48*b*. By virtue of the design of the two first contact sections 48*a*, 48*b*, a good sealing behavior of the damping element 44 can be achieved.

The contact sections 48*a*, 48*b*, 50 may be arranged in a circular shape around the central longitudinal axis L (see, in particular, FIGS. 3A, 4A). Such circular contact sections 48*a*, 50 permit both good vibration damping over the circumference of the damping element 44 as well as a good seal by means of the damping element 44.

Figure 5:
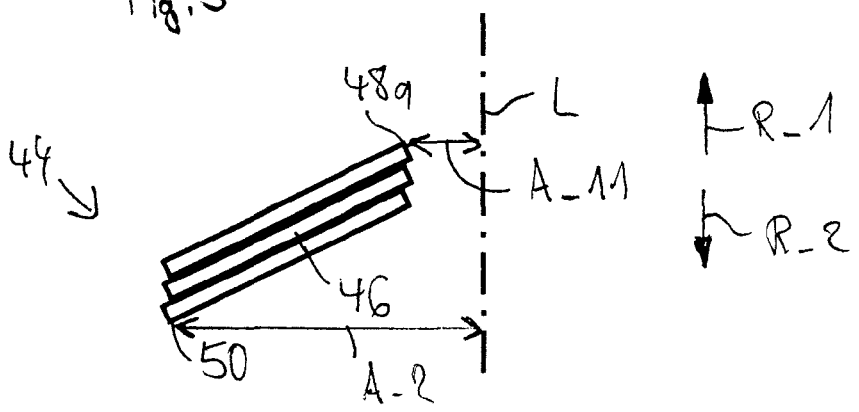
FIG. 5 shows an embodiment of a damping element embodied as a disk spring.
Figure 6:
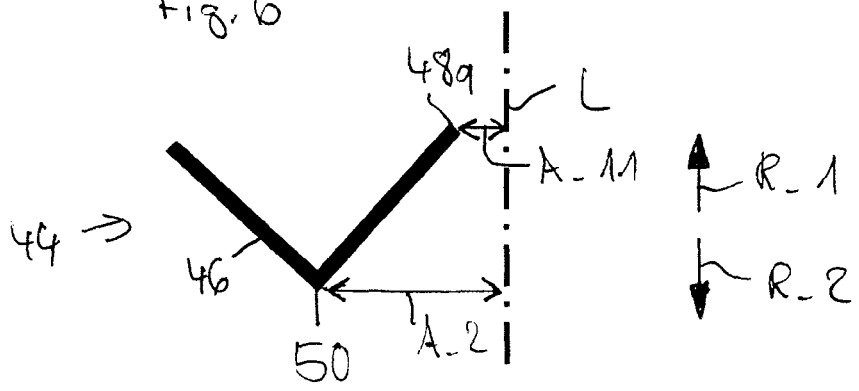
FIG. 6 shows a further embodiment of a damping element embodied as a disk spring.
Figure 7:
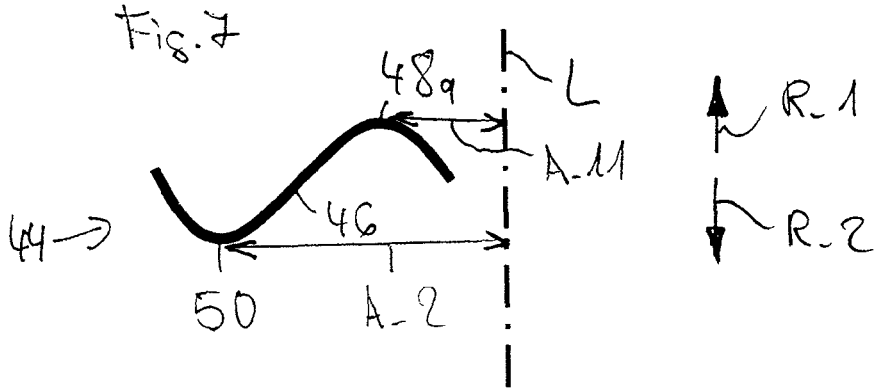
FIG. 7 shows a further embodiment of a damping element embodied as a disk spring.

In the embodiments shown in FIGS. 5 to 7, the damping element 44 is formed from one or more disk springs (FIG. 5). FIG. 6 shows a disk spring which is V-shaped in longitudinal section, and FIG. 7 shows a disk spring which is S-shaped in longitudinal section. Disk springs which are embodied or arranged in such a way permit a very good damping behavior of the damping element 44.

Figure 8:
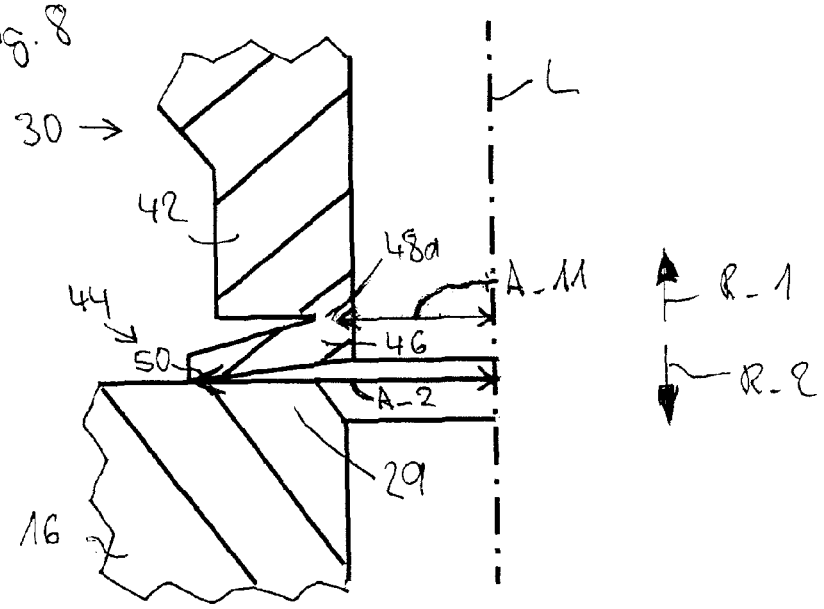
FIG. 8 shows an embodiment of a damping element which is coupled to a clamping element.
Figure 9:
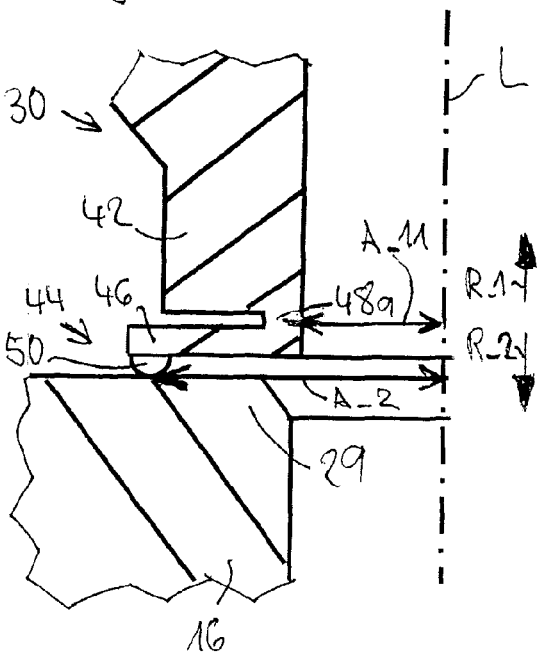
FIG. 9 shows a further embodiment of a damping element which is coupled to the clamping element.
Figure 10:
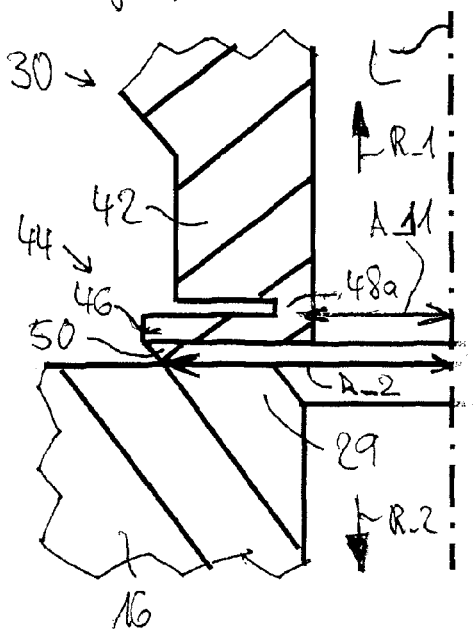
FIG. 10 shows a further embodiment of a damping element which is coupled to the clamping element.

In the embodiments shown in FIGS. 8 to 10, the damping element 44 is embodied as a disk spring (FIG. 8) or as a cylinder disk (FIGS. 9, 10), and are each coupled in one piece to the clamping element 42. This permits a good sealing behavior of the damping element 44. The contact sections 48*a*, 48*b*, 50 may be formed in the form of a semicircle (contact section 50, FIG. 9) or of a triangle (contact section 50, FIG. 10) in the longitudinal section. In further embodiments, the damping element 44 can also be embodied separately from the clamping element 42 in each case.

What is claimed is:

1. A damping element configured to damp a vibration transmitted between an injection valve body with a central longitudinal axis and a cylinder head of an internal combustion engine, the damping element comprising:

a ring-washer-shaped base body having an upper surface, a lower surface and an inner circumference, the base body adapted to encircle an injection valve body and upon assembly lie between the injection valve body and a step formed in a cylinder head recess receiving an injection valve body such that the base body lower surface is located a distance above not in contact with the cylinder head recess step;

first and second contact sections fixedly coupled to the upper surface of the base body and protruding beyond the base body in a first axial direction; and a third shaped contact section fixedly coupled to the lower surface of the base body and protruding beyond the base body in a second axial direction opposed to the first axial direction for minimally contacting a cylinder head recess step upon assembly and during engine operation, wherein the first contact section has a radial distance from the inner circumference of the ring-washer-shaped base body which is different than a radial distance of the second contact section from the inner circumference of the ring-washer-shaped base body, and the radial distance of the third contact section from the inner circumference having a value between the values of the radial distances of the first and second contact sections from the inner circumference.

2. The damping element of claim 1, wherein at least one of the contact sections comprises a ring shape extending around the inner circumference.

3. The damping element of claim 1, wherein the damping element is embodied as a disk spring.

4. An apparatus, comprising:

a cylinder head of an internal combustion engine, the cylinder head comprising a recess and a step formed in the recess;

an injection valve having a central longitudinal axis and being at least partially arranged in the recess; and a damping element arranged axially (i) in the recess encircling a portion of the valve and (ii) between the injection valve and the step, the damping element comprising:

a ring-washer-shaped base body;

at least one first triangular contact section fixedly coupled to the base body, a vertex of the first triangular contact section protruding beyond the base body in a first axial direction, the protruding vertex of the first triangular contact section contacting the injection valve or a surface in contact with the injection valve; and a second triangular contact section fixedly coupled to the base body, a vertex of the second triangular contact section protruding beyond the base body in a second axial direction opposed to the first axial direction, the vertex of the second triangular contact section contacting the step formed in the recess of the cylinder head, wherein the at least one first contact section has a radial distance from the longitudinal axis which is different than a radial distance of the second contact section from the longitudinal axis, and the base body is not in contact with the cylinder head.

5. The apparatus of claim 4, further comprising a clamping element for clamping the injection valve into the recess, the clamping element comprising the damping element.

6. The apparatus of claim 4, wherein the damping element comprises another first contact section fixedly coupled to the base body and protruding beyond the base body in the first axial direction, and wherein the radial distance of the second triangular contact section from the longitudinal axis has a value that is between the values of the radial distances of the first contact sections from the longitudinal axis.

7. The apparatus of claim 4, wherein at least one of the contact sections of the damping element comprises a ring shape extending around the central longitudinal axis.

8. The apparatus of claim 4, wherein the damping element is embodied as a disk spring.

9. A ring washer shaped clamping element for clamping an injection valve having a longitudinal axis into a recess having a step formed therein of a cylinder head apparatus of an internal combustion engine, the clamping element comprising:

a first lower circular end and a second upper circular end, the ends separated by a circular wall to form a ring washer configured to encircle a portion of an injection valve body for connection to a cylinder head;

the first lower circular end comprising a circular damping element portion, said damping element portion comprising a base body portion adapted to extend a distance above and not in contact with the step in the recess of the cylinder head upon assembly, and at least one shaped contact section extending from the base body portion adapted to contact the step in the recess of the cylinder head apparatus a distance from the longitudinal axis of the injection valve upon assembly, wherein the contact section is shaped to provide a minimal contact area between the damping element portion and the cylinder head recess step to reduce transfer of kinetic energy to a cylinder head during engine operation, and the second upper circular end adapted to securely receive a portion of an injection valve body therein.

* * * * *